US007386922B1

(12) United States Patent
Taylor et al.

(10) Patent No.: US 7,386,922 B1
(45) Date of Patent: Jun. 17, 2008

(54) SNOW-GUARD CLAMPING UNIT

(75) Inventors: Martin Taylor, Bristol, CT (US); Tamas Koyacs, Bristol, CT (US); Randy Bald, New Britain, CT (US)

(73) Assignee: Precision Molding, Plainville, CT (US)

( * ) Notice: Subject to any disclaimer, the term of this patent is extended or adjusted under 35 U.S.C. 154(b) by 19 days.

(21) Appl. No.: 11/344,299

(22) Filed: Feb. 1, 2006

(51) Int. Cl.

| | |
|---|---|
| ***A44B 11/25*** | (2006.01) |
| ***E04G 3/00*** | (2006.01) |
| ***E04G 5/06*** | (2006.01) |
| ***E04D 13/00*** | (2006.01) |

(52) U.S. Cl. ..... 24/569; 248/228.5; 248/231.61; 52/27; 24/525

(58) Field of Classification Search ..... 52/24–26, 52/588.1, 393, 27; 269/137; 24/525, 569; 248/536, 227.1, 228.2, 228.5, 231.61; 182/45
See application file for complete search history.

(56) References Cited

U.S. PATENT DOCUMENTS

| | | | | |
|---|---|---|---|---|
| 3,682,467 | A * | 8/1972 | Heinrich | 269/88 |
| 5,797,573 | A * | 8/1998 | Nasu | 248/231.31 |
| 6,164,033 | A * | 12/2000 | Haddock | 52/545 |
| 6,446,313 | B2 * | 9/2002 | Pfister | 24/514 |
| 7,013,612 | B2 * | 3/2006 | Haddock | 52/545 |
| 2002/0088196 | A1 * | 7/2002 | Haddock | 52/543 |

* cited by examiner

*Primary Examiner*—Brian Glessner
*Assistant Examiner*—Adriana Figueroa

(57) ABSTRACT

A two-piece clamping unit for attaching to a roof seam whereby a top piece contacts one side of the seam and a base piece contacts the opposite side thereof and the top and bottom pieces are threadingly secured.

3 Claims, 2 Drawing Sheets

SNOW-GUARD CLAMPING UNIT

BACKGROUND OF THE INVENTION

Snow guard devices used to prevent the falling of snow from roofs are usually attached to the upward extending roof seams. The snow-stopping metal or plastic plates are generally affixed to the seams prior to snow season and are removed there from at the end of the season.

The snow guards are usually attached to the roof seams by brackets which employ threaded screws and the like which could possible damage the seams upon extended usage.

U.S. Pat. No. 5,483,772 entitled "Mounting Device for Building Surfaces" describes attachment of such brackets to the roof seams by means of blunt-nosed screws which contact opposite sides of the seams.

Since some time is involved in fastening and removing the screws from a multitude of such brackets, it would be advantageous to fasten the snow guard device to the roof seams with a single fastener that is accessible from the top of the bracket, per se and which does come into contact with the seams.

Accordingly, one purpose of the instant invention is to provide a snow guard clamping unit that employs a fastener that attaches the unit to the roof seams without contacting the seams and which is accessible from top of the unit.

SUMMARY OF THE INVENTION

A two-piece clamping unit for attaching to a roof seam includes a top piece configured for contacting one side of the seam and a base piece configured for contacting the opposite side thereof. An extended machine screw fastener threadingly engages the top piece and the base piece for capturing the seam there between and fixedly holding the clamping unit to the seam.

DESCRIPTION OF THE PREFERRED EMBODIMENT

Figure 1:
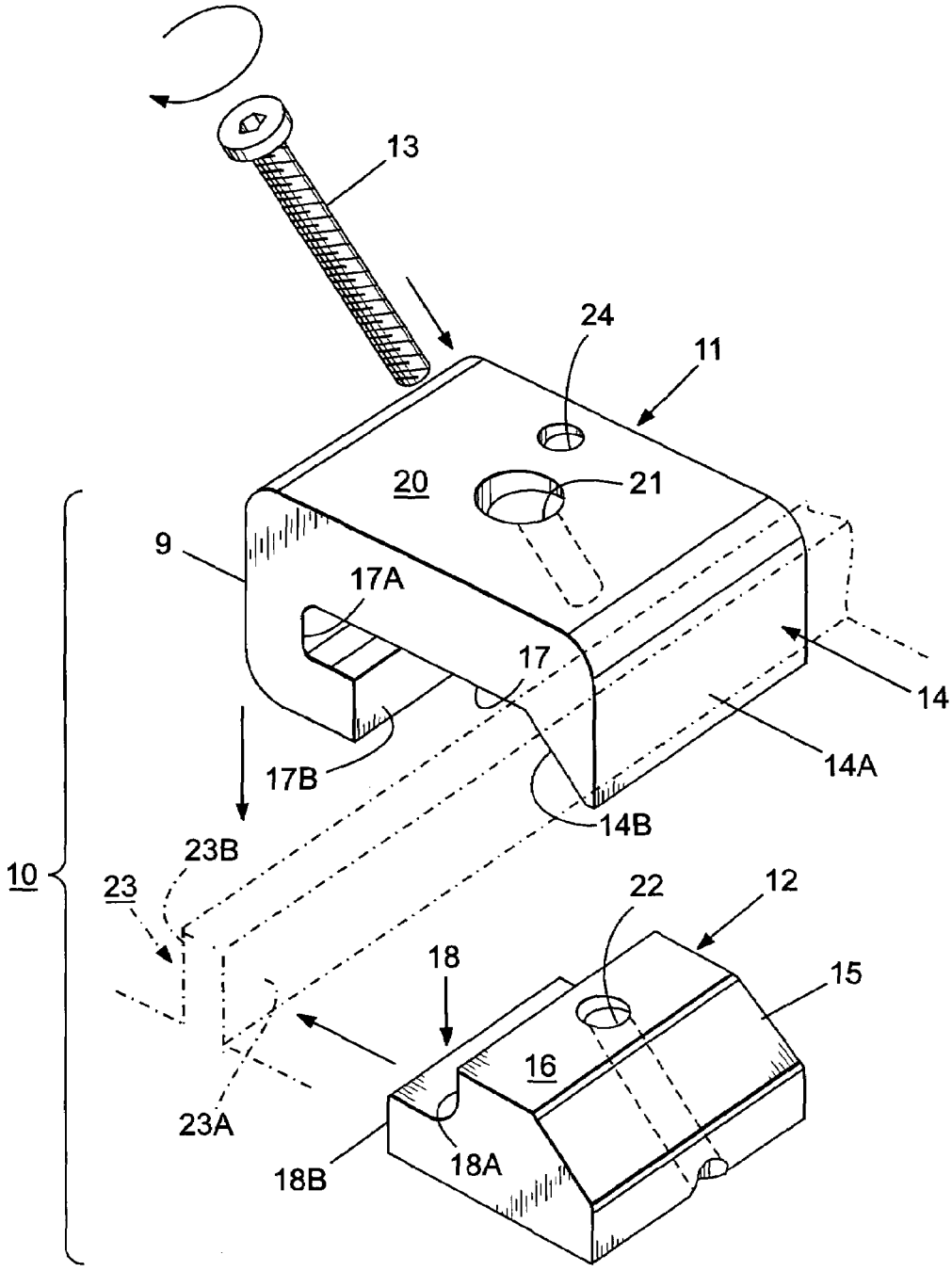
FIG. 1 is a top perspective view of the self-attaching snow-guard clamping unit of the invention prior to attaching to an upstanding roof seam.
Figure 2:
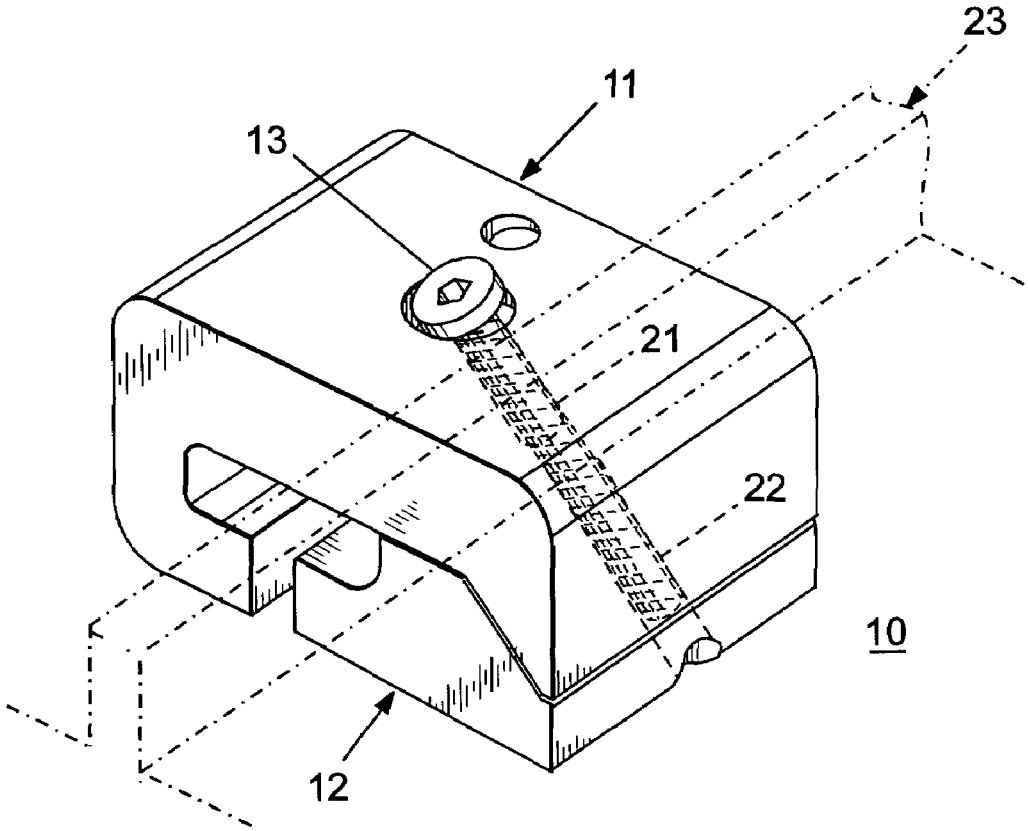
FIG. 2 is a top perspective view of the top piece and the base piece of the snow-guard clamping unit attached to the roof seam in accordance with the invention.

FIG. 1 and FIG. 2 depict the snow guard clamping unit 10, hereafter "clamping unit", according to the invention prior to attaching to an upstanding roof seam, depicted at 23 in phantom.

A shaped top piece 11 is arranged approximate one side of the seam while the shaped base 12 is arranged approximate an opposite side thereof. The top piece 11 is formed from a single piece of weather-resistant metal, such as an aluminum alloy, to define a C-shaped rear part 9, a front part 14 and a planar top 20 extending there between.

The rear part 9 of top piece 11 defines a planar slot 17A terminating at a bottom wall 17B, the function of which will be described below in greater detail. The front part 14 includes a front wall 14A and a slanting inner wall 14B, which cooperates with slanting front 15 of the base 12, when the top piece 11 is attached to the base 12.

The base 12 further defines an L-shaped rear part 18 which includes a top wall 18A, a bottom wall 18B, and a planar top part 16 extending between the L-shaped rear part 18 and the slanting front 15.

Prior to attaching the top part 11 to the base 12, the base is first moved in the indicated direction until the bottom wall 18B abuts one side 23A of the roof seam 23. The top part 11 is moved in the indicated direction such that the slanting inner wall 14B contacts the slanting front 15 of the base 12 and is guided thereon until the bottom wall 17B abuts another side 23B of the seam 23, opposite side 23A thereof.

The retainer screw 13 is then inserted within clearance hole 21 in the top 20 of the top part 11 and within the threaded opening 22 formed within top 16 and extending within the base 12. The retainer screw 13 is then rotated in the indicted direction to firmly fasten the top part 11 to the base 12. Attachment of the snow guard unit (not shown) to the assembled clamping unit 10 is obtained via the threaded opening 24 formed in the top 20 of the top part 11 as shown in the assembly of the clamping unit 10 to the seam 23 depicted in FIG. 2.

A simple arrangement for attaching a snow guard to a roof seam via a snow guard clamping unit, whereby the top part of the clamping unit is connected to the base of the clamping unit by means of a retainer screw that is accessible from the top of the clamping unit has herein been disclosed. The snow guard clamping unit captures the roof seam without engaging the seam with the retainer screw.

The invention claimed is:

1. A snow guard fastening unit for connecting said snow guard with a roof seam comprising:

a unitary top piece defining a C-shaped back part and a planar front part said C-shaped back part connected to said planar front part by a top piece planar top, said top piece front part defining a planar outer wall and a slanted inner wall, said top piece planar top includes means for attaching said snow guard, wherein said top piece C-shaped back part includes a planar slot terminating at a bottom wall and facing said slanted inner wall;

said back part and said front part being connected via an upper planar top;

a unitary bottom piece defining an L-shaped front part and a slanted back part said L-shaped front part and said slanted back part being connected via a lower planar top; and means for connecting said top piece to said bottom piece about a portion of a roof seam without engaging said roof seam, said means including a clearance opening within said top piece upper planar top, a threaded screw, and a threaded opening within said bottom piece lower planar top for receiving said threaded screw.

2. The fastening unit of claim 1 wherein said bottom piece L-shaped front part includes a top wall and a bottom wall.

3. The fastening unit of claim 1 wherein said top piece slanted inner wall contacts said bottom piece slanted back part when said top piece is attached to said bottom piece.

* * * * *